United States Patent [19]

Hoffmann

[11] 4,400,145

[45] Aug. 23, 1983

[54] DRIVESHAFT ARRANGEMENT FOR A ROTARY EXPANSIBLE CHAMBER DEVICE

[75] Inventor: Ralph Hoffmann, Eden Prairie, Minn.

[73] Assignee: Trochoid Power Corporation, Eden Prairie, Minn.

[21] Appl. No.: 246,099

[22] Filed: Mar. 20, 1981

[51] Int. Cl.[3] ..... F04C 2/00

[52] U.S. Cl. ..... 418/61 A

[58] Field of Search ..... 418/61 A; 123/242; 74/413, 414

[56] References Cited

U.S. PATENT DOCUMENTS

| | | | |
|---|---|---|---|
| 3,208,666 | 9/1965 | Fezer et al. | 418/61 A |
| 3,213,714 | 10/1965 | Hejj et al. | 418/61 A |
| 3,253,580 | 5/1966 | Eberhard et al. | 418/61 A |
| 3,260,135 | 7/1966 | Eisenhardt | 418/61 A |
| 3,268,156 | 8/1966 | Radziwill et al. | 418/61 A |
| 3,274,980 | 9/1966 | Abermeth | 418/61 A |
| 3,295,754 | 1/1967 | Abermeth et al. | 418/61 A |
| 3,875,905 | 4/1975 | Duquette | 418/61 A |

FOREIGN PATENT DOCUMENTS

| | | |
|---|---|---|
| 974436 | 11/1964 | United Kingdom . |
| 994432 | 6/1965 | United Kingdom . |

*Primary Examiner*—Charles J. Myhre

*Assistant Examiner*—Andrew M. Dolinar

*Attorney, Agent, or Firm*—Hill, Van Santen, Steadman & Simpson

[57] ABSTRACT

A driveshaft arrangement is provided for use with trochoidal rotary expansible chamber devices to afford increased driveshaft diameters for such devices. The driveshaft arrangement includes a cluster gear assembly for driving connection between a gear coaxial and mounted for rotation with the rotor and the driveshaft. A cluster gear assembly has a first gear rotatable about the centerline axis of the driveshaft and mounted in driving engagement with the rotor gear. In the case of an inner envelope type rotary device, the first gear is a pinion having a pitch diameter greater than heretofore conventionally required, thereby permitting the diameter of the driveshaft to be increased. In the case of an outer envelope type device, the rotor gear is a pinion with a pitch diameter greater than typically desired enabling an increased diameter for the driveshaft. From the first gear there follows a series of further gear drive interconnections leading to a final pinion gear connected to the driveshaft for coaxial rotation therewith. The last pinion gear meshing with the final pinion gear is adjustably mounted for an operator to set the proper timed relationship of the cluster gear assembly with compensation for machine tolerances.

32 Claims, 5 Drawing Figures

DRIVESHAFT ARRANGEMENT FOR A ROTARY EXPANSIBLE CHAMBER DEVICE

RELATED APPLICATION

This application relates to my earlier, commonly assigned application Ser. No. 146,658, filed Apr. 24, 1980, now abandoned and entitled "Rotary Device."

BACKGROUND OF THE INVENTION

1. Field of the Invention

The present invention relates to a rotary expansible chamber device of the epitrochoidal or hypotrochoidal or Wankel type and, more particularly, to means for affording an increased driveshaft diameter for such rotary devices.

2. The Prior Art

Rotary devices of the type to which the present invention may be applied generally comprise a housing defining an epitrochoidal cavity, a rotor member within the cavity and movable therearound in a planetating fashion, and a driveshaft member having an eccentric lobe means fitted thereon about which the rotor rotates. Spaces between peripheral profile surfaces on the rotor and cavity wall surfaces serve to define fluid working chambers in such rotary devices. The working chambers may be subjected to expansion forces, in which case movement of the rotor serves to power the driveshaft, such as in the case of internal combustion or steam engine usage. Alternatively, the driveshaft may serve to rotate the rotor in its housing, such as where rotary devices used as a compressor.

Epitrochoidal rotary devices may be divided into two groups referred to as inner envelope and outer envelope types. In an inner envelope configuration, the profile of the housing cavity is an epitrochoidal curve and the peripheral profile of the rotor is the inner envelope of the epitrochoidal curve. In an outer envelope device, the rotor profile is an epitrochoidal curve and the housing cavity profile is the outer envelope of that curve. The working chambers may be sealed by means including seal rings along the side surfaces of the rotor and axially extending apex seals positioned along apex or intersection lines between adjoining peripheral faces on the envelope curve surface.

In a conventional inner envelope epitrochoidal rotary device, rotation of the rotor about the eccentric lobe portion and relative rotation of the driveshaft are controlled by phasing gear mechanisms. Such phasing gear mechanisms include a ring gear fixed and rotatable with the rotor and a pinion gear fixed with respect to the device housing as shown in U.S. Pat. No. 3,881,847. As a result of engagement between the ring and pinion gears, the rotor is caused to rotate about the eccentric lobe portion during its revolution about the axis of the driveshaft. The relationship between the ring and pinion gears is such as to insure continuous contact between each of the apices of the envelope working member and the peripheral profile surfaces of the epitrochoid member.

Conventional practice has been to provide the two phasing gears with a specific gear ratio relationship which in turn has effectively limited driveshaft diameters. By limiting the driveshaft diameter, one correspondingly limits torque output from or input to the rotor of the expansible chamber device. For example, a conventional epitrochoidal rotary mechanism having an epitrochoidal cavity with two opposed concave lobe portions and a rotor with three apices requires the pitch diameter of the ring gear to be six times the rotor eccentricity, which is the distance between the axial center line of the driveshaft, and the axial center line of the rotor, and the pitch diameter of the pinion gear to be four times the same eccentricity. Because of the above necessary relationship, the ratio of ring gear pitch diameter to that of the pinion gear has heretofore always been provided as 3:2. In other words, the ring gear pitch diameter is one and one half times larger than the pinion gear pitch diameter and has one and one half times as many gear teeth. Because the driveshaft of epitrochoidal rotary units must pass through the inside of the pinion gear, these prior art rotary devices are limited to having a power shaft with a diameter less than the pitch diameter of the pinion gear.

In addition to limiting the torque that can be handled by the driveshaft for a conventionally constructed epitrochoidal rotary device, a driveshaft of limited diameter is more subject to radial force bending as a result of rotor forces, thus producing undesirable vibrations in the rotary unit. Bending of the driveshaft can cause the pinion gear to break and may lead to a high degree of wear in the pinion gear bearing. A conventionally designed driveshaft may further result in the use of journal bearing means which may be of inadequate area to carry loads imposed by the rotor.

Thus, there is a need in the art for an epitrochoidal rotary unit construction having a driveshaft with larger diameters than heretofore possible. With the structure of the present invention, pitch diameter of the pinion gear in the above-described rotary mechanism can be significantly increased without regard to design constraints dictated by the conventional relationships between the ring and pinion gear pitch diameters and rotor eccentricity. As a result of this permitted increase in pinion gear diameter, the driveshaft can also be increased.

SUMMARY OF THE INVENTION

A driveshaft arrangement having a cluster gear assembly is used for phasing gear means in a trochoidal rotary expansible chamber device having a rotor member mounted for rotary, planetating-type movement on an eccentric lobe in a housing cavity. The eccentric lobe portion is fixed to a driveshaft which extends axially through the housing and rotor. The center axis of the rotor is coaxial with the eccentric axis and this axis is spaced apart from the centerline axis of the driveshaft by a distance which is called the rotor eccentricity. For use with a rotary device of the "inner envelope" type, there is provided an internal ring gear rotatable with the rotor and concentric about the rotor axis. Pitch diameter for the internal ring gear may be selected to be as large as practicable, but is limited by the need to provide a sidewall face sealing surface between the rotor and housing cavity sidewalls. A first pinion gear is mounted interiorly of the ring gear for driving connection therewith having a center axis coaxial with the axis of the driveshaft. The pinion gear is formed at one end of a free-wheeling first gear wheel assembly having a larger pinion gear wheel formed at the other end thereof. This second pinion gear drivingly engages with a third pinion gear of relatively reduced pitch diameter formed on a second gear wheel assembly. The second gear wheel is mounted for free-wheeling rotation on a stub shaft having a centerline axis spaced apart from the driveshaft and eccentric axes. On the other end of the second gear wheel opposed from the third pinion is a fourth pinion gear having a pitch diameter substantially greater than the third pinion. The fourth pinion gear engages with a final pinion gear running concentrically with the driveshaft and keyed for rotation therewith. In accordance with the invention, the gear ratio of the internal ring gear diameter to the diameter of the first pinion gear is less than the conventionally practiced phasing gear relationship for the particular inner envelope device. The remaining gears of the gear train serve to drivingly compensate for the variation in the actual ring and pinion gear ratio from the conventionally required phasing gear ratio by transmitting a properly timed rotational speed to or from the driveshaft.

For use with an "outer envelope" type rotary device, an external pinion gear coaxial with the rotor axis is fixably mounted for rotation with the rotor. A first internal ring-type gear is positioned for driving engagement about the rotor pinion gear coaxial with the center axis of the driveshaft. The first ring gear is mounted on a free-wheeling first gear wheel assembly also containing a relatively larger second internal ring-type gear located co-axial from the first ring gear. The second ring gear drivingly engages with a third pinion gear positioned at one end of a free-wheeling second gear wheel assembly mounted for rotation on a stub shaft. A fourth pinion gear on the second gear wheel having a pitch diameter substantially greater than the third pinion drivingly engages with a final pinion gear keyed to the driveshaft for rotation therewith about the driveshaft axis. The gear ratio of the first ring gear diameter to the diameter of the rotor pinion gear is less than the conventionally practiced phasing gear relationship for the particular outer envelope epitrochoidal device. The remaining gears of the cluster gear arrangement serve to drivingly compensate for this variation in the actual ring and pinion gear ratio by transmitting a properly timed rotational speed to or from the driveshaft.

In a further embodiment of the invention, an annular housing wall member is provided for rotatably supporting the second gear wheel assembly. This wall member is provided with a cylindrical hub portion concentric about the driveshaft. A radially outer surface of the hub serves to support bearings on which the first gear wheel rotates and a radially interior surface supports separate bearings for the driveshaft. In this manner, the particular bearing requirements of the driveshaft and first gear wheel can be separately met with the proper bearings for each rotatable element.

The fourth pinion gear of the inventive cluster gear assemblies may be adjustably mounted against a mounting plate fastened to the second gear wheel shaft. This permits operator adjustment of the gear mesh between the fourth and final pinions to compensate for machine tolerances in setting the timing relationship of the driveshaft to the rotor. Such an arrangement enables precise orientation of the gear train, rotor, and driveshaft without the use of costly jigs.

DESCRIPTION OF THE PREFERRED EMBODIMENTS

As those skilled in the art will recognize, the terms "inner envelope" and "outer envelope" referred to the manner in which working member profiles are generated for epitrochoidal rotary expansible chamber devices. An epitrochoidal curve is formed by first selecting a base circle and a generating circle having a diameter greater than that of the base circle and, then, fixing a radial arm to the generating circle to trace a locus of points as the generating circle is rolled about the circumference of the base circle which is fixed. Envelope profiles are generated by fixing the epitrochoidal curve with respect to the base circle axis and rolling the base circle around the generating circle which is now fixed. An inner envelope is traced by the radially interior outline of the path made by the moving epitrochoid; while an outer envelope is traced by the radially outermost outline of this path. In an "inner envelope" device, the rotor is defined by the envelope profile and rotates in the relationship of the generating circle rolling around the base circle. In an "outer envelope" device, the rotor is defined by the epitrochoidal curve profile such that the rotor rotates in the relationship of the base circle rolling around the generating circle.

Inner envelope and outer envelope epitrochoidal profiles can take many configurations. Spaces formed between the epitrochoidal working member profile and the peripheral wall surface of the envelope working serve to define fluid working chambers, such as for engines, compressors, expanders, meters, etc. The instant invention applies to all forms of rotary trochoidal machines. Thus, although epitrochoids are illustrated, the invention has similar application to hypotrochoid devices. The designations "epitrochoid" and "hypotrochoid" refer to the manner in which a trochoidal machine's profile curves are generated as described in the Bonavera U.S. Pat. No. 3,117,561. The number of trochoidal profile shapes for use with the instant invention are endless and includes both inner and outer envelope shapes.

Figure 1:
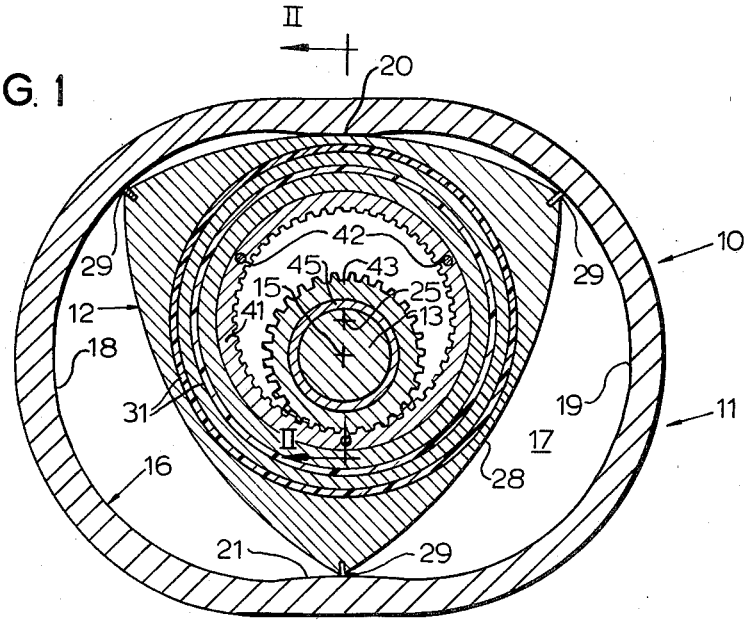
FIG. 1 is a cross-sectional transverse view through an epitrochoidal rotary expansible chamber device of the "inner envelope" type according to one embodiment of the invention.
Figure 2:
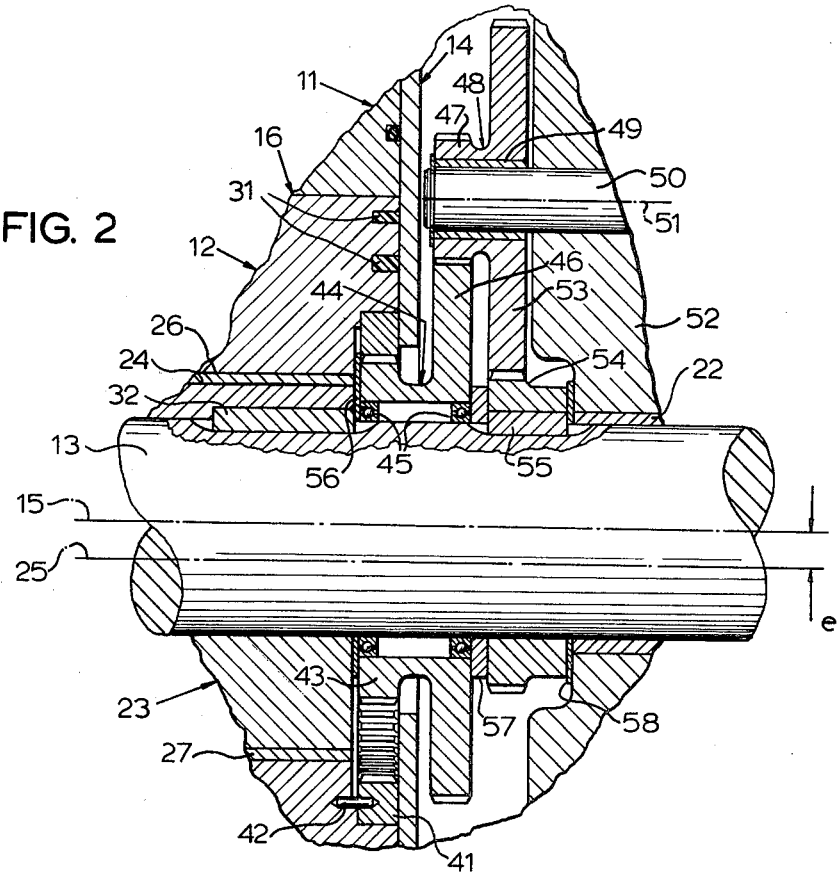
FIG. 2 is a broken-away, cross-sectional view taken substantially along line II—II of FIG. 1 illustrating a driveshaft arrangement provided for the "inner envelope" device according to the invention.

FIGS. 1 and 2 illustrate a first embodiment of the present invention for use with epitrochoidal rotary devices of the inner envelope type. The first embodiment shows rotary unit 10 having a housing 11, a rotor 12, and a driveshaft 13, which is used for the transmission of torque to or from the rotor. The housing 11 includes a pair of opposite endwalls 14 which are axially spaced from each other along the center axis 15 of the drive shaft. Between the endwalls 14, there is a peripheral wall surface 16 which serves to define an epitrochoidal cavity 17 symmetrical with respect to the axis 15. The cavity 17 includes two opposed concave lobe portions 18 and 19 which intersect at a pair of inwardly protruding wall surfaces 20 and 21. Fluid inlet and outlet ports, typically extending through the endwall surfaces 14, are not shown for the sake of simplicity. The driveshaft 13 is supported for rotation in the housing on journal means, such as bearing sleeve 22. The driveshaft carries an eccentric lobe member 23 via key means 32. The eccentric has a generally cylindrical outer surface 24. The eccentric is concentric about a second axis 25 parallel to and spaced from the center axis 15 of the driveshaft by the distance "e". This distance "e" is referred to, in the art, as the rotor eccentricity. The eccentric 23 is contained in a central circular opening 26 extending through the rotor 12. The rotor 12 is rotatably mounted relative to the outer cylindrical surface 24 of the eccentric via an annular sleeve bearing 27.

The rotor 12, which is the envelope working member, is defined by a profile surface 28 having three apices 29 located at the intersection of adjoining peripheral faces of the rotor profile. The rotor profile 28 is symmetrical about the eccentric axis 25, so that the rotor and the eccentric lobe are concentrically spaced with a common center axis 25, which is radially spaced from the center axis 15 of the driveshaft 13 by the eccentricity "e". Axially spaced endwall surfaces 30 of the rotor 12 pass along the housing cavity endwalls 14. Working chambers in the rotary device are sealably contained by apex seals extending from the rotor apices 29 and sidewall seal ring means 31 in the conventional manner.

In conventional prior art rotary devices of a configuration as illustrated in FIG. 1, a pair of spacing gears are provided to properly position the rotor 12 within the epitrochoidal cavity 17 during rotation of the driveshaft 13. As illustrated in U.S. Pat. No. 3,881,847, these prior art phasing gears, one of which is an internal ring gear connected with the rotor and the other of which is an external pinion gear connected with an endwall of the housing, function to insure that the apices 29 of the rotor are in contact with the surface of the epitrochoidal cavity 17 at all times during operation of the unit. To maintain such contact, these phasing gears must have a specific relationship to one another and a specific relationship to the eccentricity of the rotor. The relationship which has been accepted in the prior art for an inner envelope device of the type shown in FIG. 1 requires the pitch diameter of the internal ring gear to be six times the eccentricity of the rotor and the pitch diameter of the pinion gear to be four times the rotor eccentricity. Thus, the ratio of the pitch diameter of the ring gear to the pitch diameter of the pinion gear must be 3:2. With a driveshaft arrangement of the present invention, the pitch diameter of the pinion gear can be significantly increased without regard to the 3:2 ring gear-pinion gear ratio. Because of this permitted increase in pinion gear diameter, the powershaft diameter can also be increased such that the shaft 13 is able to handle higher torques and bearing loads. The invention thus permits uses of higher pressures in an expander operation and, hence, greater specific power. In operation as a compressor, the invention permits higher pressure deliveries.

FIG. 2 depicts the driveshaft arrangement of the present invention preferably used in inner envelope-type epitrochoidal rotary devices. Beginning at the rotor, 12, there is an internal ring gear 41, i.e., a gear having internally facing gear teeth, which is connected by pin means 42 for rotation with the rotor about the eccentric axis 25. Pitch diameter for the internal ring gear may be selected to be as large as practicable, but, in accordance with conventional practice, is limited by the need to provide space for sidewall seals 31 between the rotor and housing cavity sidewalls beneath the rotor periphery 28. Interiorly of the ring gear 41, there is provided a first pinion gear 43 having a plurality of externally facing gear teeth adapted for appropriate meshing with the teeth of the ring gear 41. In accordance with the present invention, the pitch diameter of the first pinion gear 43 is greater than the normally accepted four times the rotor eccentricity. Accordingly, the ratio of pitch diameter of the internal ring gear 41 to pitch diameter of the first pinion gear 43 is less than the predetermined 3:2 ratio of generating base circles from which the epitrochoidal and envelope profiles for the rotary device 10 were derived. Because the ring gear 41 and pinion gear 43 are no longer related to the eccentricity with the conventional relationship, it is necessary to compensate for this variance. Such compensation is afforded by a cluster gear assembly train which serves to drivingly interconnect the rotor ring gear 41 with the driveshaft 13.

The first pinion gear 43 is formed on a first cluster gear assembly wheel 44 mounted on bearing means 45 for free-wheeling rotation about the centerline axis 15. At the opposite end of the first cluster gear assembly wheel spaced apart from the first pinion gear 43, a second pinion gear 46 is formed having a substantially larger pitch diameter than the first pinion gear.

The second pinion gear 46 is in external driving engagement with gear teeth of a third pinion gear 47 which is formed on the forward end of a second gear cluster gear wheel 48. The second cluster gear assembly is mounted for free-wheeling rotation on a bearing sleeve 49 about a stub shaft 50 having a centerline axis 51. The stub shaft is fixably mounted in a housing wall surface 52 such that the stub shaft axis 51 extends parallel to but is spaced from the centerline and eccentric axes 15 and 25. The pitch diameter of the third pinion gear is substantially less than that for the second pinion gear 46. Spaced apart from the third pinion gear at the other end of the second cluster gear assembly is a fourth pinion gear 53 concentric with the axis 51.

The fourth pinion gear has a pitch diameter much greater than that of the third pinion gear. The gear teeth of the fourth pinion gear drivingly engage with teeth of a final pinion gear 54. The final pinion gear 54 is connected via key means 55 for coaxial rotation with the driveshaft 13. Spacer surfaces 56, 57, and 58 may be utilized to position the first gear ring assembly and final pinion gear along the driveshaft between eccentric lobe surfaces and the housing wall surface 52.

It should be further noted that several identical cluster gear assemblies such as 48 may be utilized about the first gear ring assembly 44 and final pinion gear 54 for balancing their respective torques.

To compensate for the variation in pitch diameter of the first pinion gear, pitch diameters of the subsequent gear train members 46, 47, 53, and 54 are selected by known engineering methods so that the properly timed correlation exits between rotation to the driveshaft 13 and rotation of the rotor 12. In a conventional epitrochoidal geometry, the driveshaft 13 always rotates faster than the rotor 12 and the inventive gear arrangement maintains this relationship.

Figure 3:
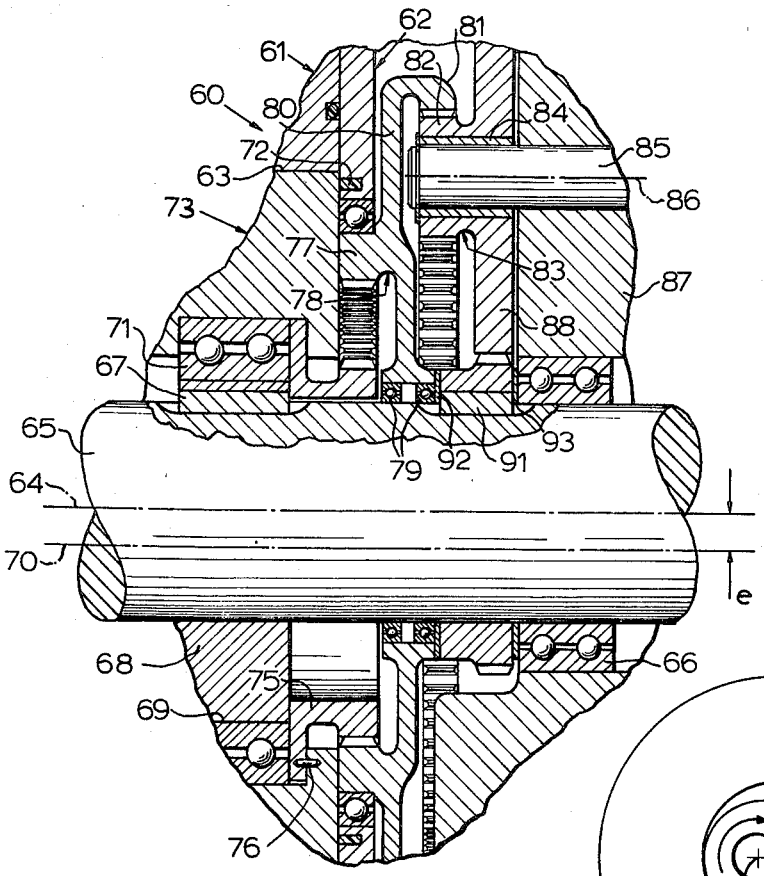
FIG. 3 is a broken-away, cross-sectional view illustrating a driveshaft arrangement provided for an epitrochoidal rotary device of the "outer envelope" type according to a second embodiment of the invention.

FIG. 3 illustrates a driveshaft arrangement for use with trochoidal rotary devices of outer envelope type. An outer envelope device 60 is similarly formed with a housing 61 including a pair of opposed endwalls 62 and defining therebetween a peripheral cavity wall surface 63, the envelope working member. The cavity profile 63 is symmetrical with respect to the centerline axis 64 of a driveshaft 65. The driveshaft is supported for rotation in the housing 61 on journal means, such as indicated by roller bearings 66. The driveshaft 65 is fixably connected by key means 67 with an eccentric lobe member 68 having a generally cylindrical outer surface 69. The eccentric is rotatable about an eccentric axis 70 parallel to and spaced from the centerline axis 64 of the driveshaft by the distance "e" or rotor eccentricity. An epitrochoidally profiled rotor 73 is rotatably mounted relative to the outer cylindrical surface 69 of the eccentric via roller bearing means 71. The rotor and the eccentric lobe are concentrically spaced with 70 being their common center axis.

While outer envelope profiles for rotor and housing cavity members are configured differently from inner envelope devices, the general operation of the devices remains the same. Working chambers are formed in the outer envelope rotary device between the periphery of the rotor and cavity wall surfaces 63 and are sealably contained by apex seals extending from apices formed in the envelope or cavity wall profile and rotor sidewall seal ring means 72.

The inventive drive arrangement begins with an external pinion gear 75 which is connected by pin means 76 for rotation with the rotor about the eccentric axis 70. Exteriorly positioned of the rotor pinion gear 75 is a first ring gear 77 having a plurality of internally facing gear teeth adapted for appropriate meshing with the teeth of the pinion gear 75. The relationship which has heretofore been accepted in the prior art for the ratio of rotor pinion gear pitch diameter to ring gear pitch diameter is varied such that the pinion gear diameter is increased, affording significant permissible increasing of the diameter of the driveshaft. Again, pitch diameter for the ring gear may be selected to be as large as practical, but, in accordance with conventional practice, is limited by the need to provide space for sidewall seals 72 between the rotor and housing cavity sidewalls beneath the rotor periphery. Accordingly, the pitch diameter ratio between the rotor pinion gear 75 and the ring gear 77 is substantially greater than the ratio which would be normally accepted for such an outer envelope device. A cluster gear assembly train is subsequently provided to drivingly interconnect the rotor pinion gear 75 with the driveshaft 65 in such a way as to compensate for this variance. The pinion gear 75 preferably differs in pitch diameter from that of the ring gear 77 by twice the eccentricity "e".

The first ring gear 77 is formed on a first cluster gear assembly wheel 78 mounted on roller bearing means 79 for free-wheeling rotation about the centerline axis 64. Located opposed from the first ring gear, there is formed on the first cluster gear assembly wheel a substantially radially extending arm or flange 80 with a second ring gear 81 formed at the tip thereof and facing inward.

The second ring gear 81 is in internal driving engagement with gear teeth of a third pinion gear 82 which is formed on the forward end of a second cluster gear assembly wheel 83. The second cluster gear assembly 83 is mounted for free-wheeling rotation on a bearing sleeve 84 fitted about a stub shaft 85 having a centerline axis 86. The stub shaft is fixedly mounted in a housing wall 87 such that the stub shaft axis extends parallel to but is spaced from the centerline and eccentric axes 64 and 70. Pitch diameter of the third pinion gear is substantially less than that of the second ring gear 81. Spaced apart from the third pinion gear 82 at the other end of the second cluster gear wheel 83 is a fourth pinion gear 88 concentric about the axis 86.

The fourth pinion gear has a pitch diameter much greater than that of the third pinion gear. The gear teeth of the fourth pinion gear drivingly engage with teeth of a final pinion gear 90. The final pinion gear 90 is connected for coaxial rotation with the driveshaft 65 via key means 91. Spacers 92 and 93 may be utilized to position the first gear ring assembly and final pinion gear along the driveshaft.

Again it should be further noted that more than one second cluster gear wheel 83 may be utilized about the first cluster gear assembly wheel and final pinion gear for balancing purposes. By this means, each assembly wheel 83 carries less torque in direct proportion to the number of assemblies used such that gears used in assembly 83 may be narrower as less strength is required of their teeth.

Pitch diameters of the gear train members subsequent to the first pinion gear 77 are selected by known engineering methods so that the properly timed correlation exists between rotation of the driveshaft 65 and rotation of the rotor 70. The driveshaft always rotates faster than the rotor.

Figure 4:
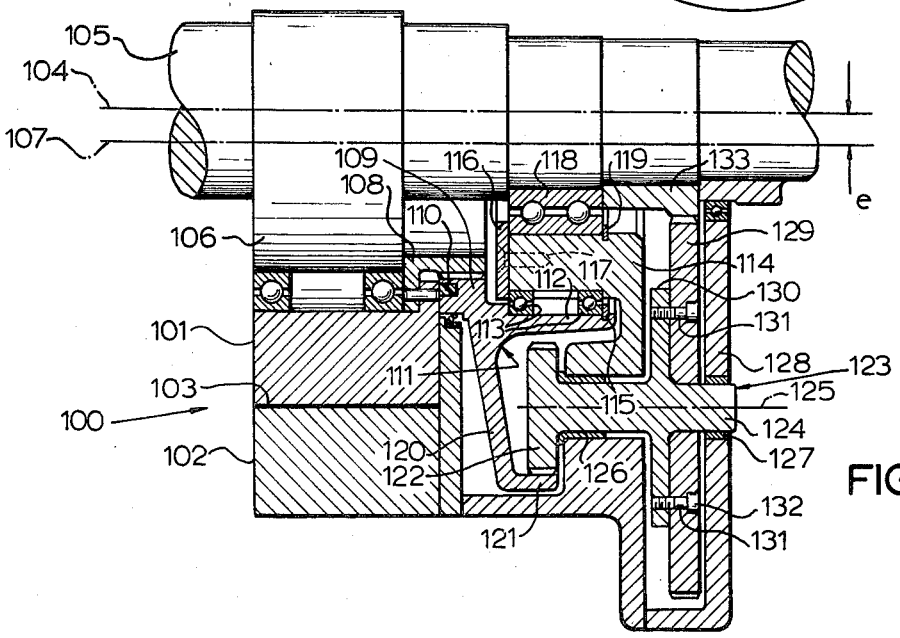
FIG. 4 is a broken-away, cross-sectional view illustrating a driveshaft arrangement provided for an epitrochoidal rotary device of the "outer envelope" type according to a third embodiment of the invention.

FIG. 4 illustrates another embodiment of the invention driveshaft arrangement similar to FIG. 3 embodiment, but having a different housing construction. This housing arrangement may also be adapted to an inner envelope device as those skilled in the art will appreciate. As with FIG. 3, the device 100 is an outer envelope rotary mechanism having an epitrochoidally profiled rotor 101 positioned for rotation in a housing 102. An inner cavity wall surface 103 of the housing is symmetrical with respect to the centerline axis 104 of a driveshaft 105. The driveshaft is formed with an eccentric lobe member 106 having a generally cylindrical outer surface concentric about an eccentric axis 107 spaced from the centerline axis 104 by the distance "e".

The inventive drive arrangement operates in the manner of the drive assembly described above in connection with FIG. 3. However, the various drive train gears are spaced throughout the housing in order to reduce bearing loads and permit access for adjustment of gear mesh should such be needed. The drive arrangement begins with an external pinion gear 108 which is connected for rotation with the rotor about the eccentric axis 107. Exterior of the pinion gear 108 is a first ring gear 109 having internally facing gear teeth adapted for appropriate meshing with the teeth of the pinion gear 108. As described above, the ratio of pitch diameter of the rotor pinion gear 108 to the pitch diameter of the ring gear 109 is varied such that the pinion gear diameter is increased, thus permitting a significant increase in the diameter of the driveshaft 105. Pitch diameter for the pinion gear 108 may be selected to be as large as practical, allowing for the need to provide space for sidewall seals 110 between the rotor and housing cavity sidewalls beneath the rotor periphery. The pitch diameter ratio between the rotor pinion gear 108 and the first ring gear 109 is substantially greater than the ratio which would normally be accepted for such an outer envelope device. The further members of the drive arrangement serve to drivingly interconnect the rotor gear 108 with the driveshaft 105 in such a way as to compensate for this variance.

The first ring gear 109 is formed on a first cluster gear wheel assembly 111. The first wheel assembly 111 contains an axially extending flange portion 112 mounted on roller bearing means 113 for free-wheeling rotation about the centerline axis 104. The roller bearing means 113 are mounted on a hub portion 114 of a fixed housing wall extending concentric about said driveshaft. A locking ring 115 is positioned at the outer tip of the axially extending flange portion 112 to locate the bearing means 113 in position on the housing wall 114. At the opposed axial end of the bearing means, there is provided a removable lock ring 116 which is held by bolts 117 against an axially facing free end of the housing hub 114 which serves to contain the bearing means 113 pressed against the ring member 115. Radially inward of the housing hub 114 opposed from roller bearing means 113 is a journal means 118 for rotatably supporting the driveshaft 105. The journal bearing 118 is axially retained between a lock ring 119 and the removable ring 116 in the manner of the bearing means 113. Thus, the housing hub 114 permits the first cluster gear assembly 111 to be supported on bearings separate from the driveshaft 105, and, hence, not requiring to be of the constructional strength necessary to be mounted on the driveshaft.

A radially extending arm or flange portion 120 extends outward from the flange portion 112 on the wheel assembly 111 to define a second ring gear 121 at the top thereof. The second ring gear 121 is in internal driving engagement with gear teeth of a third pinion gear 122 which is formed on the forward end of a second cluster gear assembly wheel 123. The gear wheel 123 has a stub shaft member 124 rotatable about a centerline axis 125. The stub shaft is mounted for free-wheeling rotation by means of a bearing sleeve member 126 fitted in the housing wall 114 and an end bearing sleeve 127 positioned in an exterior housing wall surface 128. The stube shaft axis 125 extends parallel to but is spaced from the centerline and eccentric axis 104 and 107. Pitch diameter of the third pinion gear 122 is substantially less than that of the second ring gear 121. Spaced apart from the third pinion gear across the housing wall 114 is a fourth pinion gear 129 concentric about the axis 125.

The fourth pinion gear 129 contains a hollow center enabling a slidable fit on the stub shaft 124. A radially extending annular flange portion 130 is formed on the stub shaft 124 to serve as a mounting plate against which the fourth pinion gear 129 is locked by means of a plurality of bolt members 131. The mounting plate 130 is relatively smaller than the fourth pinion 129 so that the fourth pinion extends radially outward beyond the plate. The bolt members 131 fit into corresponding circumferentially spaced tap holes formed about the mounting plate 130; however, relatively elongated arcuate slot recesses 132 are preferably formed in the fourth pinion gear sidewall to accommodate the bolt heads. These slots 132 permit a fine circumferential adjustment of the fourth pinion gear relative to the mounting plate so that the operator can adjust the meshing engagement of the gear teeth thereof with the teeth of a final pinion gear 133 and so compensate for machine tolerances. This gear adjustment arrangement eliminates the need for costly jigs for the gear train members. Maximum adjustment is expected, for normal machine tolerances, to require no more than changing the gear mesh of the fourth pinion 129 with the final pinion 133 by one tooth. After the gear mesh adjustment has been set so that the proper timing relationship is established between the rotor and the crankshaft 105, the fourth pinion is locked in place on the mounting plate 130 and the drive train gears then maintain the phasing orientation. Although not shown, this mounting plate gear adjustment arrangement may also be used for the fourth pinion gear 53 of the inner envelope device discussed above. In order to permit such adjustment at the fourth pinion gear assembly, the exterior wall surface 128 may be removable by means not shown.

The final pinion gear 133 is fastened for coaxial rotation to the driveshaft 105. As described above, more than one second gear wheel assembly 123 may be utilized about the first cluster gear wheel assembly 111 and final pinion gear for balancing and torque handling purposes.

Pitch diameters of the gear train members subsequent to the rotor pinion gear 108 are selected by known engineering methods so that the properly timed correlation exists between rotation of the driveshaft 105 and rotation of the rotor 101. One manner by which the various pitch diameters may be arrived at will now be described with reference to FIG. 5 which schematically illustrates the inventive drive train for an outer envelope device such as shown in FIGS. 3 and 4.

Figure 5:
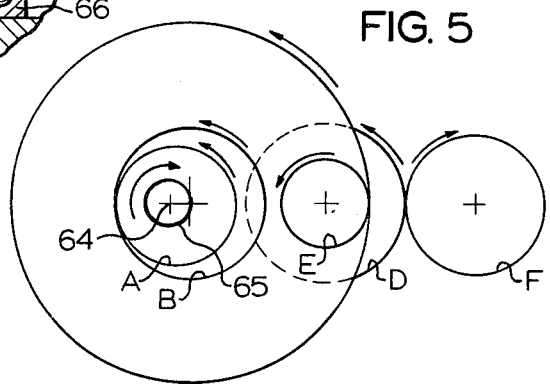
FIG. 5 is a schematic diagram representing the gear train drive connections for the driveshaft arrangements of FIGS. 3 and 4.

With reference to FIG. 5, assume the circles represent the various pitch diameters for the gears in the drive train such that circle A denotes the rotor pinion gear, circle B represents the first ring gear, circle C is the second ring gear, circle E represents the third pinion gear, circle D denotes the fourth pinion gear, and circle F is the final pinion gear keyed for rotation concentric with the driveshaft. In accordance with the invention, the pitch diameter of the rotor pinion gear A has been enlarged to the maximum diameter possible, limited only by the desire to have a rotor sidewall face seal about the central hollow of the rotor. For instance, in a typical application, where the outer envelope device has a housing cavity surface comprised of four lobe sections ($Z=4$) the rotor should revolve $\frac{1}{4}$ of a revolution for each full revolution of the driveshaft. To accomplish this, conventional phasing gear arrangements have heretofore utilized a rotor pinion gear having a pitch diameter six times the eccentricity of the driveshaft in engagement with a fixed ring gear having a pitch diameter eight times the eccentricity. In accordance with the invention, the rotor pinion gear is made larger so as to be no longer $\frac{3}{4}$'s the pitch diameter of the ring gear. The actual rotation of the rotor for one revolution of the driveshaft is equal to $$1-A/B$$

The variance K, or the amount by which the rotor has not revolved $\frac{1}{4}$ of a revolution, is then equal to $$K = \tfrac{1}{4} - \left(1 - \frac{A}{B}\right)$$

which can be reduced to $K=(4A-3B)/4B$

Assuming B to have 80 teeth and A to have 68 teeth, K then equals $(272-240)/320$ or $1/10$. In addition, those skilled in the art will readily appreciate that K must equal $$\frac{1}{10} = \frac{F}{D} \times \frac{E}{C}.$$

Also, the pitch diameters must all add up, therefore $$F+D+E=C.$$

Having two equations and four variables, two of the variables must be fixed by design. Accordingly, presume the ratio of E/D is equal to $\frac{1}{3}$ and let F equal 3.5 inches. Substituting in above, $$3.5 + 3E + E = C \text{ or}$$
$$C = 4E + 3.5,$$
$$\text{such that } E = 2.0416.$$

Since D=3E, then D=6.1249. F is 3.5 and the sum of F+D+E=11.6665. Hence, C=11.6665.

Pitch diameters having values like 11.6665 are not practical and not conducive to the design of a gear having a whole number of teeth, which gears require. Thus, when the first calculation leads to non-integers for pitch diameters, the designer will make a successive calculation, assuming different initial variables, such as for the ratio of E/D and the diameter of F, to obtain properly practical pitch diameters.

Such design formulations could be readily accomplished on a computer program to provide more choices, since slight variations in A and B directly effects the calculations of C, D, E, and F. Further, it may turn out that the eccentricity would have to be slightly changed to accomodate the gears. However, a slight change in eccentricity, although possibly detrimental to work chamber displacement, could be accommodated with minimal detrimental effects by varying the rotor width.

Although various minor modifications may be suggested by those versed in the art, it should be understood that I wish to embody within the scope of the patent warranted hereon all such modifications as reasonably and properly come within the scope of my contribution to the art.

I claim as my invention:

1. A rotary expansible chamber device having a housing formed by a peripheral wall surface defining a trochoidal cavity symmetrical about a first axis, a rotor mounted in said cavity and symmetrical about a second axis parallel to but spaced from said first axis, a driveshaft means having a centerline axis coaxial with said first axis, an eccentric lobe portion connected with said driveshaft means for supporting said rotor for rotational movement about said second axis, and a phasing gear assembly for maintaining said driveshaft rotation faster than said rotor, comprising a rotor gear, concentric about said second axis and connected for rotation with said rotor, a first cluster gear wheel assembly, supported for free-wheeling rotation about said first axis and in driving connection with said rotor gear, a second cluster gear wheel assembly in driving connection with said first cluster gear wheel assembly and supported for free-wheeling rotation about a third axis spaced from said first and second axes, and a final pinion gear in driving connection with second cluster gear wheel assembly and connected to said driveshaft for rotation about said first axis, said first cluster gear wheel assembly having a first gear and a second gear and said second cluster gear assembly wheel having a third pinion gear and a fourth pinion gear, said first gear being in gear mesh engagement with said rotor gear, said second gear being in gear mesh engagement with said third pinion gear, said fourth pinion gear being in gear mesh engagement with said final pinion gear, wherein said rotor gear is a pinion and said first gear is a ring such that said rotor gear is interior of said first gear and pitch diameter for said first gear is greater than pitch diameter for said rotor gear.

2. The rotary device of claim 1, wherein said third axis is parallel to said first and second axes.

3. The rotary device of claim 1, further comprising a plate support means for adjustably carrying said fourth pinion gear, wherein said plate support means comprises circumferentially spaced tap holes for receiving corresponding bolt means and is of a relatively smaller radial length than said fourth pinion gear, said fourth pinion gear is formed with arcuate slot means through which said bolt means pass to said tap holes, such that said fourth pinion gear is adjustable relative to said final pinion gear to vary the relative rotational timing between said rotor and said driveshaft.

4. The rotary device of claim 1, wherein pitch diameter for said fourth pinion gear is greater than corresponding pitch diameters for said third and final pinion gears.

5. The rotary device of claim 1, wherein said device is an outer envelope type trochoidal rotary device.

6. The rotary device of claim 1, wherein said rotor is being driven from said driveshaft.

7. A driveshaft arrangement for an outer envelope trochoidal rotary expansible chamber device, having a housing having a cavity and a rotor mounted in said cavity, said cavity and rotor having peripheral profiles derived from generating and base circles having a predetermined ratio of base circle diameter to generating circle diameter, comprising a driveshaft, rotatable about a first axis parallel but spaced from a second axis about which said rotor is rotatable, and a phasing gear assembly comprising a pinion gear connected to said rotor for rotation therewith about said second axis, a first ring gear in gear mesh engagement with said pinion gear and rotatable about said first axis, the ratio of pitch diameter of said pinion gear to pitch diameter of said first ring gear being more than said predetermined ratio, a final pinion gear connected to said driveshaft for rotation therewith about said first axis, and a gear train means in driving interconnection between said first ring and final pinion gears for maintaining rotation of said driveshaft faster than rotation of said rotor, said gear train means comprising first and second cluster gear wheel assemblies mounted for free-wheeling rotation about said first axis and a third axis spaced from said first and second axes, respectively, said first cluster gear wheel assembly carrying said first ring gear and a second ring gear and said second cluster gear wheel assembly carrying a third pinion gear and a fourth pinion gear, said second ring gear being in gear mesh engagement with said third pinion gear and said fourth pinion gear being in gear mesh engagement with said final pinion gear.

8. The driveshaft arrangement of claim 7, wherein pitch diameter for said second ring gear is greater than corresponding pitch diameters for said first and third pinion gears.

9. The driveshaft arrangement of claim 8, wherein pitch diameter for said fourth pinion gear is greater than corresponding pitch diameters for said third and final pinion gears.

10. The driveshaft arrangement of claim 7, wherein said third axis is parallel to said first and second axes.

11. The driveshaft arrangement of claim 7, wherein said pinion gear is interior of said first ring gear and pitch diameter for said first ring gear is greater than pitch diameter for said pinion gear.

12. The driveshaft arrangement of claim 7, wherein said second cluster gear wheel assembly is supported for rotation in a housing wall with said third and fourth pinion gears positioned on opposed sides thereof.

13. The driveshaft arrangement of claim 12, wherein said housing wall is substantially concentric about said driveshaft and formed with a hub portion having first and second separate bearing means on radially spaced, opposed surfaces for supporting said first cluster gear wheel and said driveshaft, respectively.

14. The driveshaft arrangement of claim 13, wherein said hub portion has an axially facing free end adjacent said two bearing means, a removable lock ring means positioned in said free end for containing said two bearing means on said hub portion.

15. The driveshaft arrangement of claim 13, wherein said first cluster gear wheel assembly comprises a radially extending annular flange portion, carrying said first gear in the form of a ring at an inner end and said second gear in the form of a ring at an outer end, and an axially extending annular flange portion extending outward from said radial flange portion, said axial flange portion supporting said first cluster gear wheel assembly rotatably about said first bearing means.

16. The driveshaft arrangement of claim 7, further comprising an adjustable mounting means for carrying said fourth pinion gear on said second cluster gear wheel assembly such that gear mesh engagement of said fourth pinion with said final pinion is adjustable for setting the relative rotational timing between said rotor and said driveshaft.

17. The driveshaft arrangement of claim 16, wherein said adjustable mounting means comprises an annular plate member fixedly connected to said second cluster gear wheel assembly and having circumferentially spaced tap holes for receiving corresponding bolt means, said fourth pinion gear being formed with arcuate slot means through which said bolt means pass to said tap holes for variable circumferential positioning of said fourth pinion gear relative to said plate member.

18. A rotary expansible chamber device having a housing formed by a peripheral wall surface defining a trochoidal cavity symmetrical about a first axis, a rotor mounted in said cavity and symmetrical about a second axis parallel to but spaced from said first axis, a driveshaft means having a centerline axis coaxial with said first axis, an eccentric lobe portion connected with said driveshaft means for supporting said rotor for rotational movement about said second axis, and a phasing gear assembly for maintaining said driveshaft rotation faster than said rotor, comprising a rotor gear concentric about said second axis and connected for rotation with said rotor, a first cluster gear wheel assembly supported for free-wheeling rotation about said first axis and in driving connection with said rotor gear, a second cluster gear wheel assembly in driving connection with said first cluster gear wheel assembly and supported for free-wheeling rotation about a third axis spaced from said first and second axes, and a final pinion gear in driving connection with said second cluster gear wheel assembly and connected to said driveshaft for rotation about said first axis, the improvement comprising:

an annular housing wall substantially concentric about said driveshaft and formed with an axially extending hub portion and first and second bearing means contained on radially spaced opposed surfaces of said hub portion for supporting said first cluster gear wheel and said driveshaft, respectively.

19. The rotary device of claim 18, wherein said second cluster gear wheel assembly is supported for rotation in said housing wall with said third and fourth pinion gears positioned on opposite sides of said housing wall.

20. The rotary device of claim 18, wherein said rotor is being driven from said driveshaft.

21. The rotary device of claim 18, wherein said device is an outer envelope type trochoidal rotary device.

22. A rotary expansible chamber device having a housing formed by a peripheral wall surface defining a trochoidal cavity symmetrical about a first axis, a rotor mounted in said cavity and symmetrical about a second axis parallel to but spaced from said first axis, a driveshaft means having a centerline axial coaxial with said first axis, an eccentric lobe portion connected with said driveshaft means for supporting said rotor for rotational movement about said second axis, and a phasing gear assembly for maintaining said driveshaft rotation faster than said rotor, comprising a rotor gear, concentric about said second axis and connected for rotation with said rotor, a first cluster gear wheel assembly, supported for free-wheeling rotation about said first axis and in driving connection with said rotor gear, a second cluster gear wheel assembly in driving connection with said first cluster gear wheel assembly and supported for free-wheeling rotation about a third axis spaced from said first and second axes, and a final pinion gear in driving connection with said second cluster gear wheel assembly and connected to said driveshaft for rotation about said first axis, said first cluster gear wheel assembly having a first gear and a second gear and said second cluster gear assembly wheel having a third pinion gear and a plate support means for adjustably carrying a fourth pinion gear, said first gear being in gear mesh engagement with said rotor gear, said second gear being in gear mesh engagement with said third pinion gear, said fourth pinion gear being in gear mesh engagement with said final pinion gear and adjustable relative thereto to vary the relative rotational timing between said rotor and said driveshaft, said second cluster gear wheel assembly being supported for rotation in a housing wall with said third and fourth pinion gears positioned on opposed sides thereof, said housing wall being substantially concentric about said driveshaft and formed with a hub portion having first and second separate bearing means on radially spaced, opposed surfaces for supporting said first cluster gear wheel and said driveshaft, respectively.

23. The rotary device of claim 22, wherein said third axis is parallel to said first and second axes.

24. The rotary device of claim 22, wherein said plate support means comprises circumferentially spaced tap holes for receiving corresponding bolt means and is of a relatively smaller radial length than said fourth pinion gear, said fourth pinion gear is formed with arcuate slot means through which said bolt means pass to said tap holes.

25. The rotary device of claim 22, wherein pitch diameter for said fourth pinion gear is greater than corresponding pitch diameters for said third and final pinion gears.

26. The rotary device of claim 25, wherein said device is an inner envelope type epitrochoidal rotary device.

27. The rotary device of claim 26, wherein said third axis is parallel to said first and second axes.

28. The rotary device of claim 22, wherein said rotor gear is a pinion and said first gear is a ring such that said rotor gear is interior of said first gear and pitch diameter for said first gear is greater than pitch diameter for said rotor gear.

29. The rotary device of claim 28, wherein said device is an outer envelope type trochoidal rotary device.

30. The rotary device of claim 22, wherein said hub portion has an axially facing free end adjacent said two bearing means, a removable lock ring means positioned in said free end for containing said two bearing means on said hub portion.

31. The rotary device of claim 22, wherein said device is an outer envelope type trochoidal rotary device and said first cluster gear wheel assembly comprises a radially extending annular flange portion, carrying said first gear in the form of a ring at an inner end and said second gear in the form of a ring at an outer end, and an axially extending annular flange portion extending outward from said radial flange portion, said axial flange portion supporting said first cluster gear wheel assembly rotatably about said first bearing means.

32. The rotary device of claim 22, wherein said rotor is being driven from said driveshaft.

* * * * *